US006998556B1

(12) United States Patent
Ho

(10) Patent No.: US 6,998,556 B1
(45) Date of Patent: Feb. 14, 2006

(54) SWITCHING DEVICE

(75) Inventor: Shu-Wei Ho, Taichung Hsien (TW)

(73) Assignee: Excel Cell Electronic Co., Ltd., (TW)

( * ) Notice: Subject to any disclaimer, the term of this patent is extended or adjusted under 35 U.S.C. 154(b) by 0 days.

(21) Appl. No.: 11/045,084

(22) Filed: Jan. 31, 2005

(51) Int. Cl.
*H01H 13/12* (2006.01)

(52) U.S. Cl. ..... 200/531; 200/532

(58) Field of Classification Search ..... 200/530–532, 200/536, 61.76, 341, 61.81
See application file for complete search history.

(56) References Cited

U.S. PATENT DOCUMENTS 3,818,169 A * 6/1974 Kobemus ..... 200/531
5,369,238 A * 11/1994 Hirata ..... 200/530
5,508,505 A * 4/1996 Walts et al. ..... 235/462.46
5,828,024 A * 10/1998 Takano et al. ..... 200/531
5,836,442 A * 11/1998 Hirano ..... 200/284
6,483,061 B1 * 11/2002 Harvey et al. ..... 200/532
6,861,605 B1 * 3/2005 Wong ..... 200/550

* cited by examiner

*Primary Examiner*—Elvin G. Enad
*Assistant Examiner*—Lisa Klaus
(74) *Attorney, Agent, or Firm*—Banner & Witcoff, Ltd.

(57) ABSTRACT

A switching device includes a casing having two opposite lateral walls, two spaced-apart terminal plates secured in a bottom wall of the casing, and a slide unit. The lateral walls respectively have opposite guide faces that extend downwardly and inclinedly toward each other, and opposite limiting faces that extend downwardly and respectively from the guide faces toward the bottom wall. The slide unit includes a slide piece mounted movably within the casing, and a conductive piece connected to the slide piece and disposed between the limiting faces. The slide piece is slidable along the guide faces to move the conductive piece between first and second positions, where the conductive piece contacts conductively and moves away from the terminal plates, respectively. A biasing unit is provided for biasing the conductive piece to the second position.

8 Claims, 7 Drawing Sheets

SWITCHING DEVICE

BACKGROUND OF THE INVENTION

1. Field of the Invention

The invention relates to a switching device, more particularly to a switching device that can provide a high degree of electrical stability.

2. Description of the Related Art

Referring to FIGS. 1 and 2, a conventional switching device 1 includes a rectangular casing 11, two metal terminal plates 12, a slide unit 13, a biasing unit 14, and a top cover 15.

The casing 11 is made of plastic, and includes front, rear and bottom walls 115, 113, 111, and two opposite lateral walls 112 between the front, rear and bottom walls 115, 113, 111. The front, rear, bottom and lateral walls 115, 113, 111, 112 cooperate to define a receiving space 116. A limiting groove 114 is formed in the bottom wall 111.

The metal terminal plates 12 are embedded respectively in two opposite sides of the bottom wall 111.

The slide unit 13 includes a plastic slide block 131 mounted slidably within the receiving space 116, and two metal conductive pieces 132 fixed respectively to two opposite sides of the slide block 131. The slide block 131 and the conductive pieces 132 are assembled by insert molding. The slide block 131 has a press portion 1311 projecting outwardly from the casing 11, and a slide portion 1312 located within the receiving space 116. The slide portion 1312 has a planar bottom face in contact with a groove surface of the limiting groove 114, and is restricted to slide along the limiting groove 114.

The biasing unit 14 is sleeved on the slide block 131 for biasing the same toward a non-conductive state.

The top cover 15 is provided to cover the casing 11.

In use, the press portion 1311 of the slide block 131 is operated so as to move the conductive pieces 132 between a conductive state, where the conductive pieces 132 contact electrically the respective terminal plates 12, and a non-conductive state, where the conductive pieces 132 are not in electrical contact with the respective terminal plates 12.

Although the aforementioned conventional switching device 1 can achieve its intended purpose, it has the following disadvantages:

1. Since the slide block 131 and the conductive pieces 132 are assembled by insert molding, during manufacture of the slide unit 13, the conductive pieces 132 are first positioned in a mold, after which a plastic material is injected into the mold to form the slide block 131. Such an insert molding process consumes much time, thereby increasing costs. Furthermore, when the conductive pieces 132 are inserted into the slide block 131 during insert molding, they deform easily. This adversely affects manufacturing productivity of the slide unit 13.

2. Since the bottom face of the slide portion 1312 is in direct contact with the groove surface of the limiting groove 114, the slide portion 1312 produces a large friction with the groove surface of the limiting groove 114 when it slides along the limiting groove 114. This results in significant wearing of these components, thereby shortening the service life of the conventional switching device 1.

3. Since the slide portion 1312 is not fitted exactly in the limiting groove 114 so that gaps 2 exist between the slide portion 1312 and the limiting groove 114, when the press portion 1311 is improperly operated, the slide portion 1312 tends to deviate either to the left or to the right, thereby destabilizing electrical connections between the conductive pieces 132 and the terminal plates 12.

SUMMARY OF THE INVENTION

Therefore, the object of the present invention is to provide a switching device that has a high degree of electrical stability and that can produce minimum wear during a sliding action so as to increase its service life.

According to this invention, a switching device comprises a casing, two spaced-apart terminal plates, a slide unit, and a biasing unit. The casing has front, rear and bottom walls, and two opposite lateral walls between the front, rear and bottom walls. The front, rear, bottom, and lateral walls cooperate to define a receiving space. The lateral walls respectively have opposite guide faces that extend downwardly and inclinedly toward each other, and opposite limiting faces that extend downwardly and respectively from the guide faces toward the bottom wall. The terminal plates are secured in the bottom wall. The slide unit includes a slide piece mounted movably within the receiving space, and a conductive piece connected to the slide piece and disposed between the limiting faces of the lateral walls. The slide piece is slidable along the guide faces of the lateral walls to move the conductive piece between a first position, where the conductive piece contacts conductively the terminal plates, and a second position, where the conductive piece moves away from the terminal plates. The biasing unit biases the conductive piece to the second position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
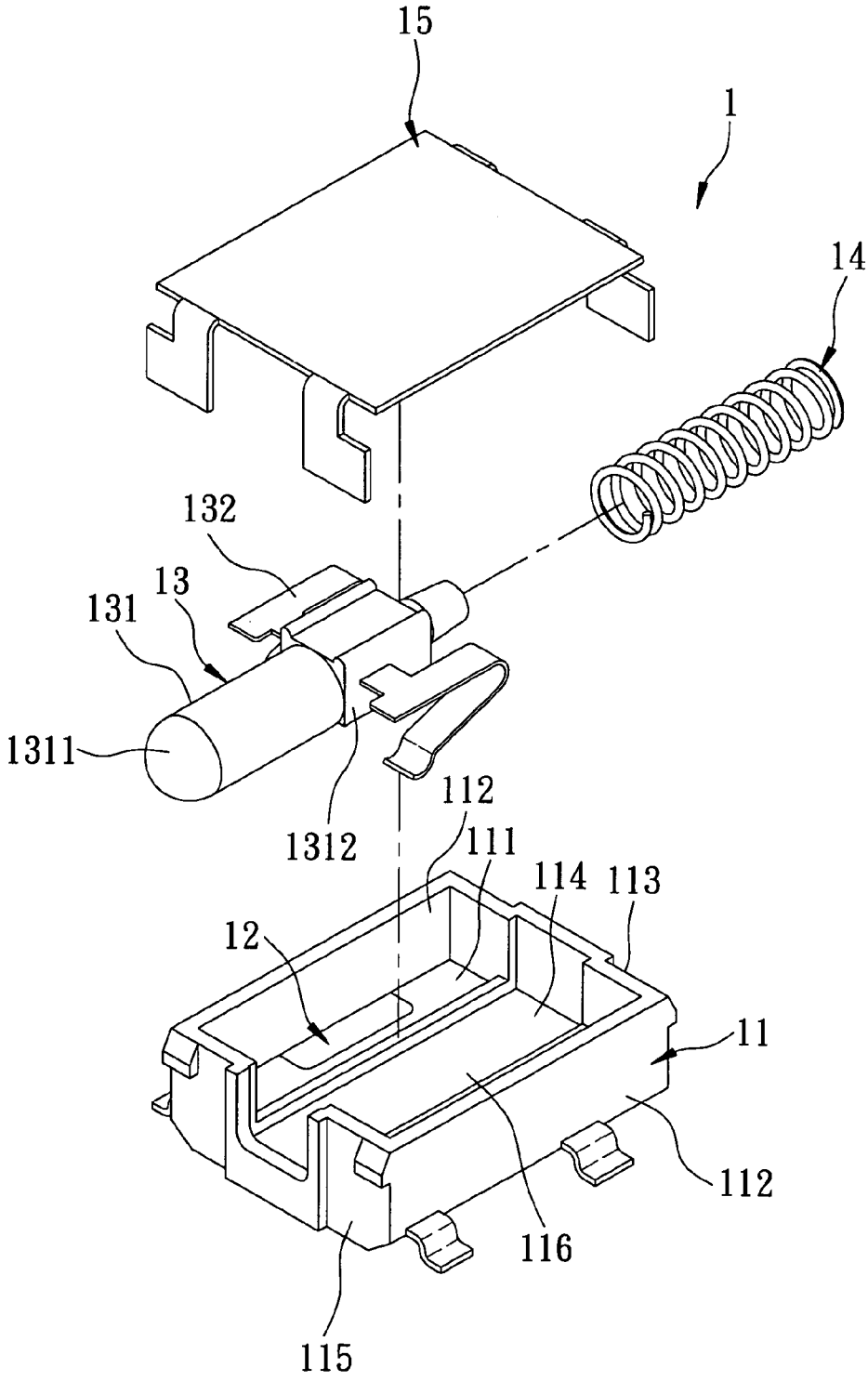
FIG. 1 PRIOR ART
FIG. 1 is an exploded perspective view of a conventional switching device.
Figure 2:
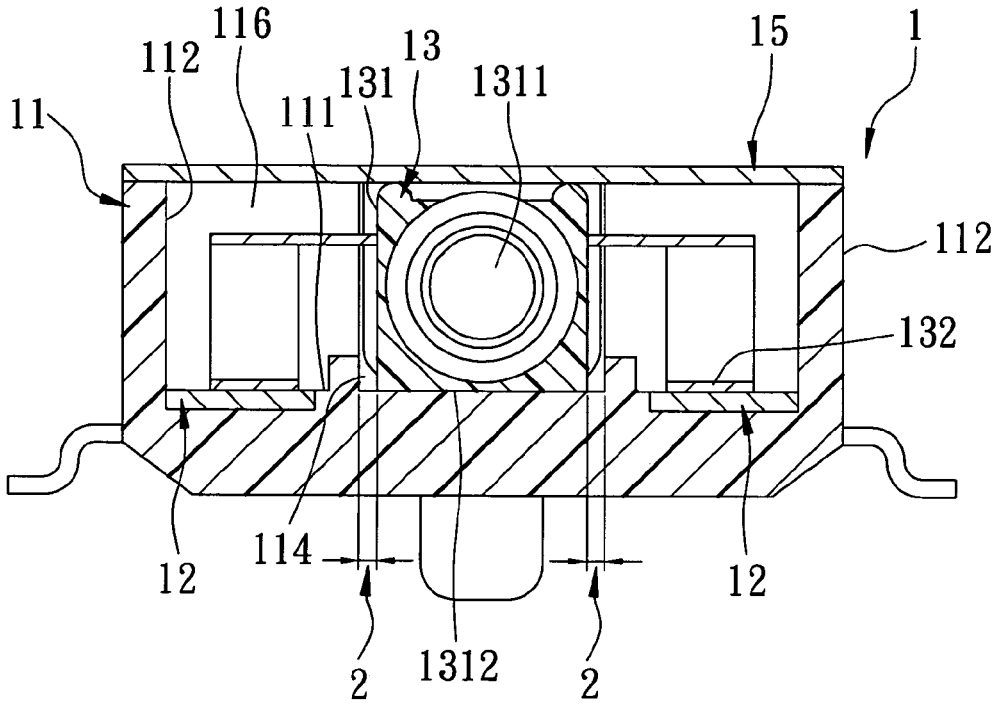
FIG. 2 PRIOR ART
FIG. 2 is a sectional view of the conventional switching device.
Figure 3:
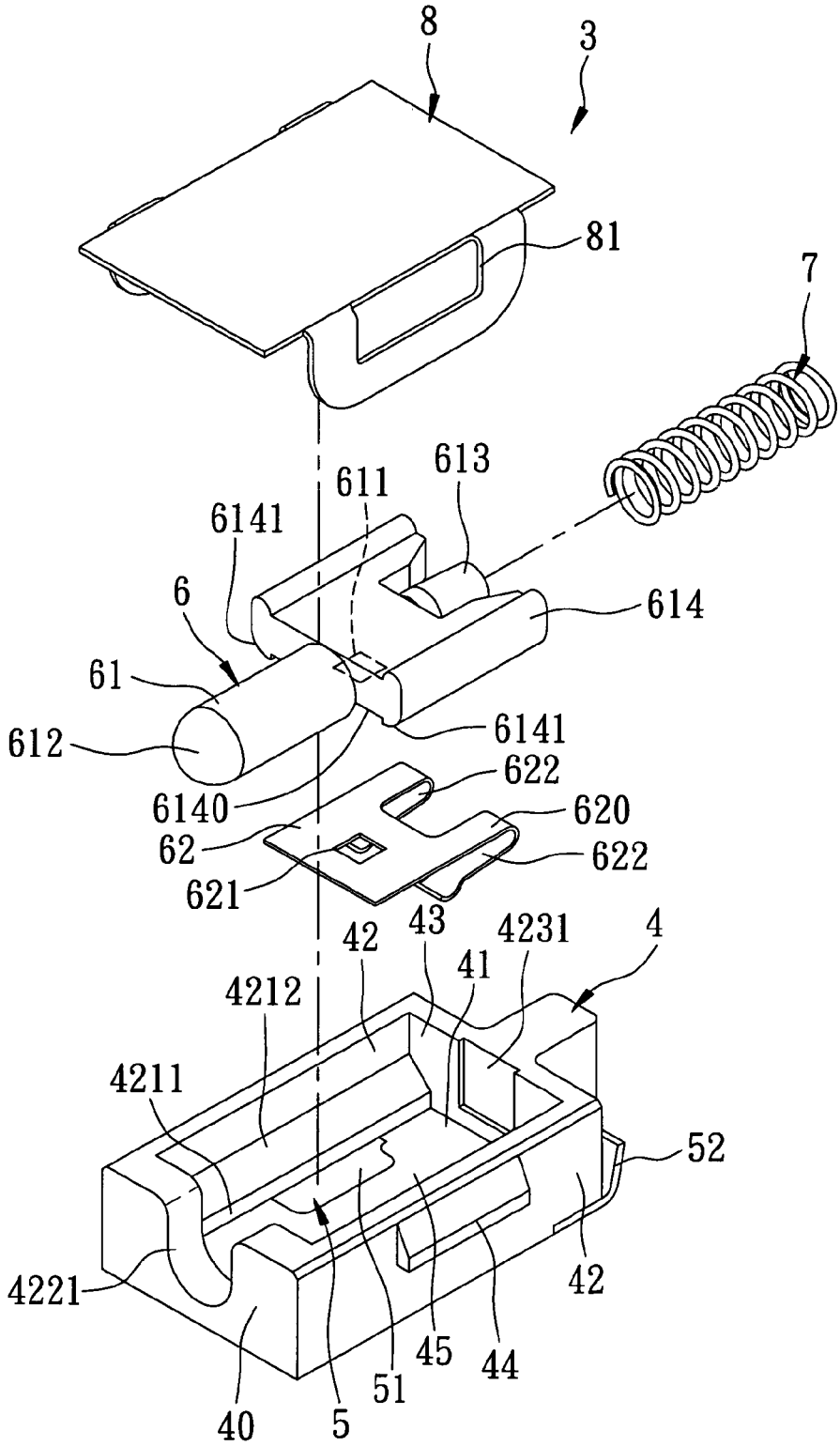
FIG. 3 is an exploded perspective view of the preferred embodiment of a switching device according to the present invention.
Figure 4:
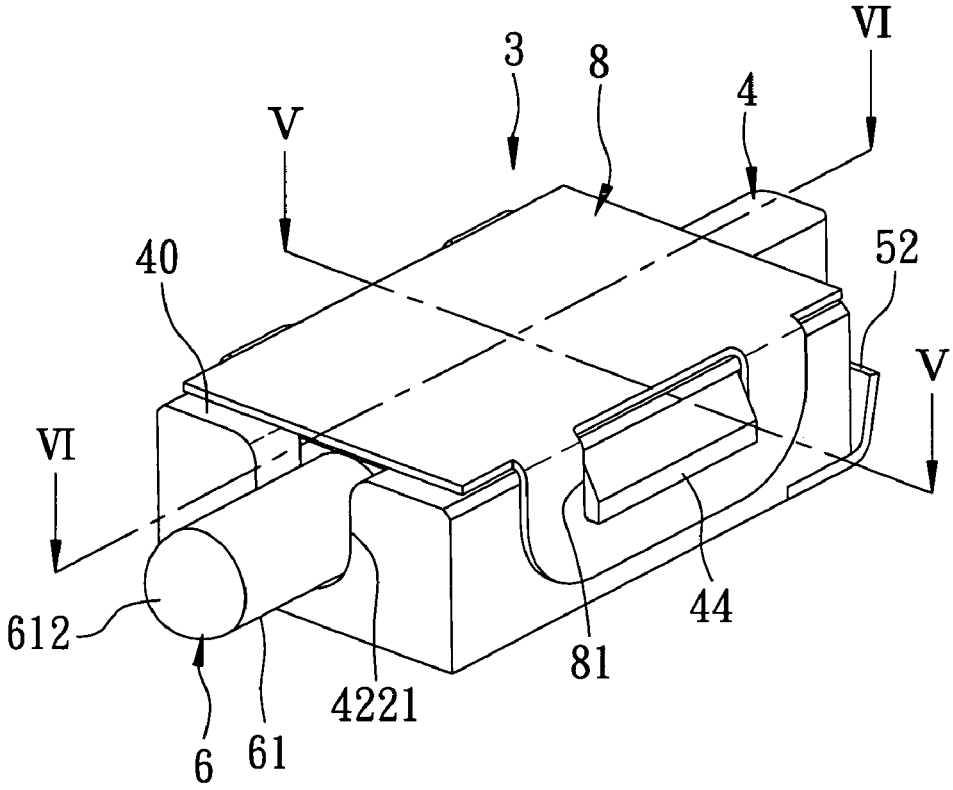
FIG. 4 is a perspective view of the preferred embodiment in an assembled state.

Referring to FIGS. 3 to 7, the preferred embodiment of a switching device 3 according to the present invention is shown to comprise a rectangular casing 4, two spaced-apart metal terminal plates 5, a slide unit 6, a biasing unit 7, and a top cover 8.

The casing 4 is made of an insulating material, such as rubber or plastic, and includes front, rear and bottom walls 40, 43, 41, and two opposite lateral walls 42 between the front, rear and bottom walls 40, 43, 41. The front, rear, bottom and lateral walls 40, 43, 41, 42 cooperate to define a receiving space 45. The front wall 42 has a notch 4221. The rear wall 43 has a limiting groove 4231. The lateral walls 42 respectively have guide faces 4212 that extend oppositely, downwardly and inclinedly toward each other, and opposite limiting faces 4211 that extend downwardly and respectively from the guide faces 4212 toward the bottom wall 41.

The metal terminal plates 5 are embedded respectively in two opposite sides of the bottom wall 41 in a conventional manner. Each of the terminal plates 5 includes an inner contact conductive section 51 extending on the bottom wall 41, and an outer connecting section 52 that is connected integrally to the inner contact conductive section 51, that extends outwardly from the casing 4, and that is adapted to connect electrically an electrical device (not shown).

Figure 5:
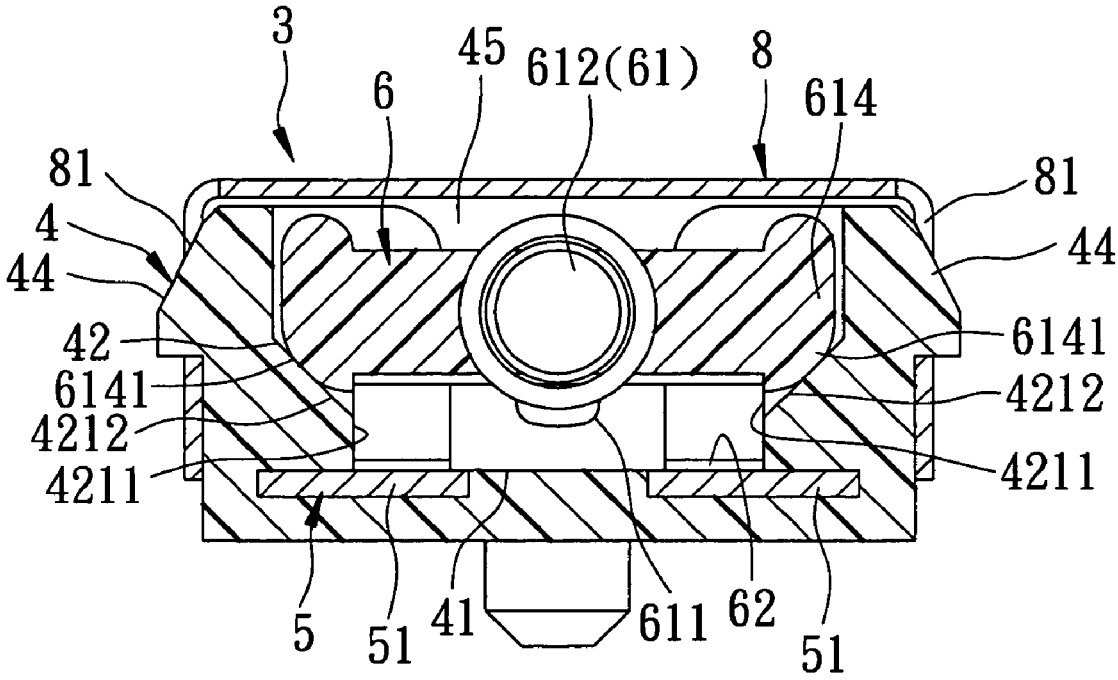
FIG. 5 is a sectional view of the preferred embodiment taken along line V—V of FIG. 4.

The slide unit 6 includes a slide piece 61 mounted movably within the receiving space 45, and a metal conductive piece 62 connected to the slide piece 61 and disposed between the limiting faces 4211 of the lateral walls 42. In this embodiment, the slide piece 61 includes a press portion 612, an engaging portion 613 opposite to the press portion 612, and a slide portion 614 between the press and engaging portions 612, 613. The slide portion 614 includes a bottom side which has a grooved face 6140, a protrusion 611 projecting downwardly from the grooved face 6140, and two slide sections 6141 on two sides of the groove face 6140. The slide sections 6141 are curved, and are seated slidably and respectively on the guide faces 4212 of the lateral walls 42, as best illustrated in FIG. 5.

Figure 6:
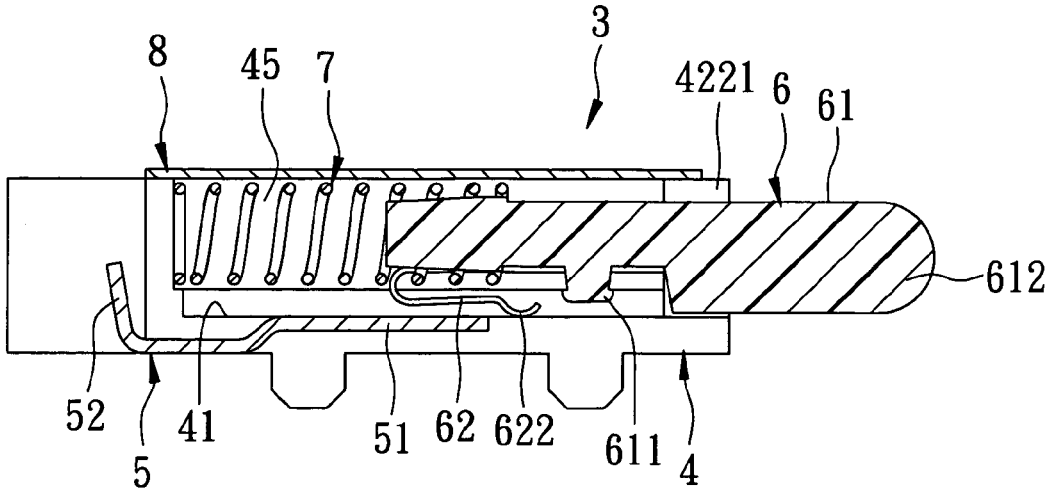
FIG. 6 is another sectional view of the preferred embodiment taken along line VI—VI of FIG. 4.

The conductive piece 62 is fixed to a bottom side of the slide piece 61, as best shown in FIG. 6, and has a base plate portion 620 received in the grooved face 6140, an engaging hole 621 formed in the base plate portion 620 to receive the protrusion 611, and two spaced-apart resilient arms 622 extending downwardly from the base plate portion 620 to contact the inner contact conductive sections 51 of the terminal plates 5, respectively.

Figure 8:
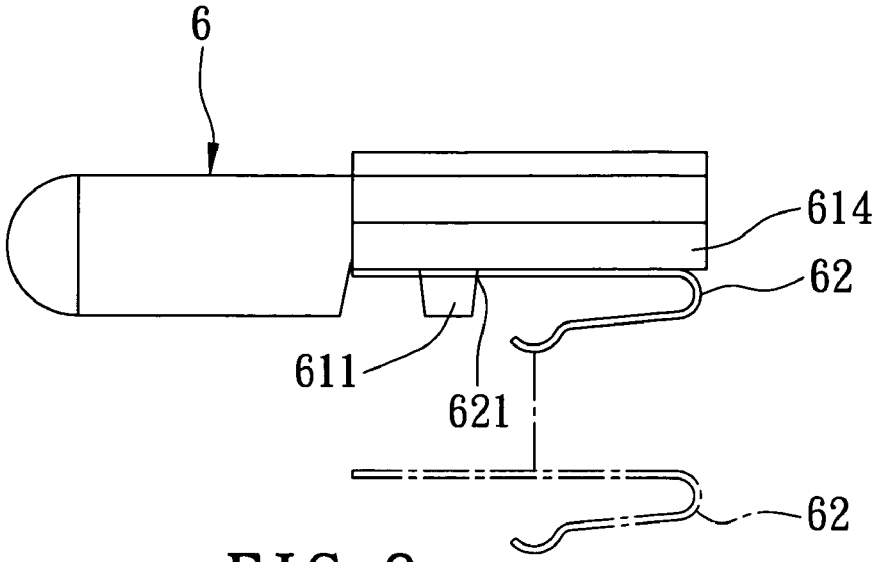
FIG. 8 is a schematic view of a slide unit of the preferred embodiment, illustrating how the conductive piece is assembled to the slide unit.
Figure 9:
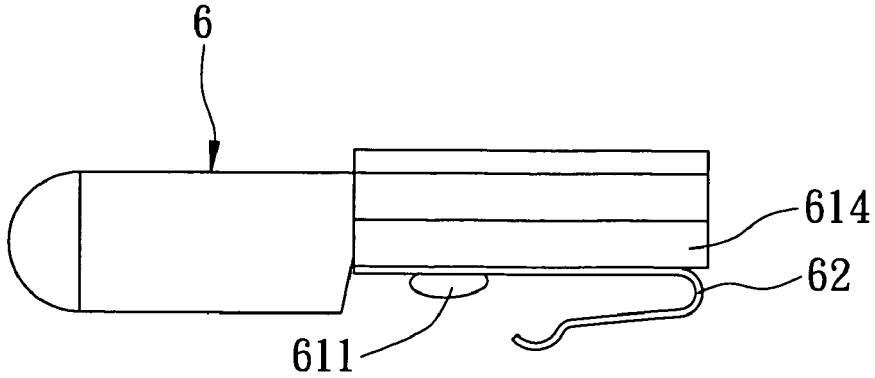
FIG. 9 is a view similar to FIG. 8, but illustrating the conductive piece after being assembled to the slide portion.

Referring to FIGS. 8 and 9, the protrusion 611 of the slide portion 614 is formed into a rivet by means of a tool (not shown) after being received in the engaging hole 621 of the conductive piece 62.

Figure 7:
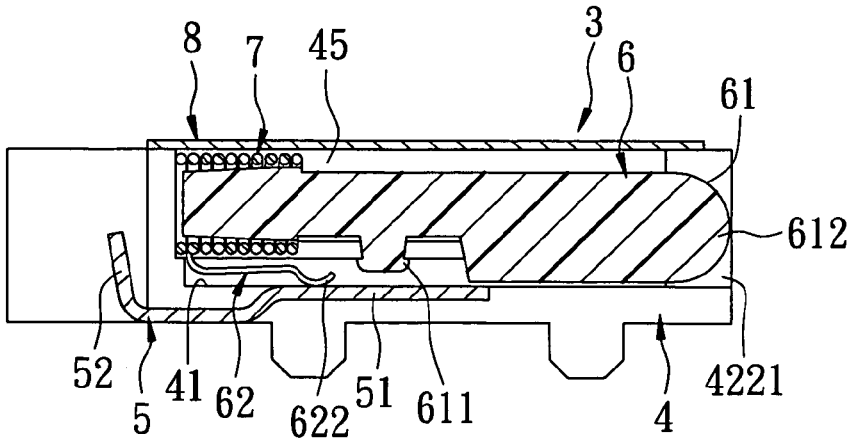
FIG. 7 is a view similar to FIG. 6, but illustrating a conductive piece in a first position.

The slide sections 6141 of the slide portion 614 are slidable along the guide faces 4212 of the lateral walls 42 to move the conductive piece 62 between first and second positions. In the first position, as illustrated in FIG. 7, the resilient arms 622 (only one is visible in FIG. 7) of the conductive piece 62 contact conductively and respectively the inner contact conductive sections 51 (only one is visible in FIG. 7) of the terminal plates 5. In the second position, as illustrated in FIG. 6, the resilient arms 622 (only one is visible in FIG. 6) of the conductive piece 62 move away from the inner contact conductive sections 51 (only one is visible in FIG. 6) of the terminal plates 5.

The biasing unit 7 is a spring, and has two opposite ends connected respectively to the engaging portion 613 of the slide piece 61 and the limiting groove 4231 of the casing 4. The biasing unit 7 biases the slide piece 61 to the second position.

The top cover 8 is provided to cover the casing 4, and has two opposite sides provided respectively with engaging holes 81. The lateral walls 42 of the casing 4 are provided with projections 44 for engaging respectively the engaging holes 81 in the sides of the top cover 8 so that the top cover 8 is secured to the casing 4.

In use, the press portion 612 of the slide piece 61 is pressed so as to move the conductive piece 62 to the first position shown in FIG. 7. A working signal may be transmitted to the electrical equipment at this time through the outer connecting sections 52 of the terminal plates 5. When the press portion 612 is released from its depressed position, the conductive piece 62 is biased by the biasing unit 7 to the second position shown in FIG. 6.

The steps involved in producing the switching device 3 of the present invention may be summarized as follows:

(a) forming the top cover 8 by stamping;

(b) constructing the slide unit 6 by first forming the plastic slide piece 61 with the protrusion 611, then separately forming the conductive piece 62 with the engaging hole 621 by stamping, followed by electroplating the conductive piece 62, sleeving the conductive piece 62 on the protrusion 611 of the slide unit 6 through the engaging hole 621, and forming the protrusion 611 into a rivet by means of a tool (not shown) to thereby fix the conductive piece 62 to the slide portion 614;

(c) constructing the casing 4 by first forming the terminal plates 5 and electroplating the same, followed by placing the terminal plates 5 in a mold and forming the casing 4 over the terminal plates 5, and removing excess material from the terminal plates 5; and (d) assembling the top cover 8, the slide unit 6, the casing 4, and the biasing unit 7 by an automatic assembly machine (not shown). Since the automatic assembly machine is known in the art, and is not pertinent to the present invention, a detailed description of the same will be dispensed herewith for the sake of brevity.

The switching device 3 of the present invention, therefore, has the following advantages:

1. The slide piece 61 and the conductive piece 62 of the present invention are interconnected by riveting the conductive piece 62 to the bottom side of the slide piece 61, whereas the slide block 131 and the conductive piece 132 of the conventional switching device 1 shown in FIG. 1 are made by an insert molding process. Hence, less working hours are needed during production of the present invention. Furthermore, the slide unit 6 is assembled by riveting, a high quality pass rate can be maintained, thereby minimizing the production costs.

2. Since only the two curved slide sections 6141 of the slide portion 614 of the slide unit 6 are in contact with the guide faces 4212 of the lateral walls 42, frictional force between the slide portion 614 and the guide faces 4212 is substantially reduced, thereby prolonging the service life of the switching device 3 of the present invention.

3. Since the two curved slide sections 6141 of the slide portion 614 of the slide unit 6 are in contact with the guide faces 4212 of the lateral walls 42, during sliding movement of the slide portion 614, the slide portion 614 will not deviate either to the right or to the left because of lack of any gap between the slide sections 6141 and the guide faces 4212. Hence, movement of the slide portion 614 within the receiving space 43 is enhanced, which results in stable electrical connection between the conductive piece 62 and the terminal plates 5.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A switching device comprising:

a casing having front, rear and bottom walls, and two opposite lateral walls between said front, rear and bottom walls, said front, rear, bottom, and lateral walls cooperating to define a receiving space, said lateral walls respectively having opposite guide faces that extend downwardly and inclinedly toward each other, and opposite limiting faces that extend downwardly and respectively from said guide faces toward said bottom wall;

two spaced-apart terminal plates secured in said bottom wall;

a slide unit including a slide piece mounted movably within said receiving space, and a conductive piece connected to said slide piece and disposed between said limiting faces of said lateral walls, said slide piece being slidable along said guide faces of said lateral walls to move said conductive piece between a first position, where said conductive piece contacts conductively said terminal plates, and a second position, where said conductive piece moves away from said terminal plates; and a biasing unit for biasing said conductive piece to said second position.

2. The switching device as claimed in claim 1, wherein said conductive piece is riveted to a bottom side of said slide piece.

3. The switching device as claimed in claim 1, wherein said slide piece includes a bottom side which has a grooved face, a protrusion projecting from said grooved face, and two slide sections on two sides of said grooved face which are seated slidably and respectively on said guide faces.

4. The switching device as claimed in claim 3, wherein said conductive piece has a base plate portion received in said grooved face, an engaging hole formed in said base plate portion to receive said protrusion, and two spaced-apart resilient arms extending downwardly from said base plate portion to contact said terminal plates, respectively.

5. The switching device as claimed in claim 4, wherein said protrusion is formed into a rivet after being received in said engaging hole.

6. The switching device as claimed in claim 3, wherein said slide sections are curved.

7. The switching device as claimed in claim 1, wherein each of said terminal plates includes an inner contact conductive section extending on said bottom wall, and an outer connecting section extending outwardly from said casing and adapted to connect electrically an electrical device.

8. The switching device as claimed in claim 1, further comprising a top cover to cover said casing.

* * * * *